United States Patent [19]

Grossman et al.

[11] Patent Number: 4,698,547

[45] Date of Patent: Oct. 6, 1987

[54] LOW PRESSURE ARC DISCHARGE LAMP APPARATUS WITH MAGNETIC FIELD GENERATING MEANS

[75] Inventors: Mark W. Grossman, Belmont; William A. George, Rockport; Jakob Maya, Brookline, all of Mass.

[73] Assignee: GTE Products Corporation, Danvers, Mass.

[21] Appl. No.: 830,151

[22] Filed: Feb. 18, 1986

[51] Int. Cl.[4] ..... H01J 1/50; H01J 17/14; H01J 61/35

[52] U.S. Cl. ..... 313/485; 313/156; 313/161

[58] Field of Search ..... 313/485, 153, 156, 161

[56] References Cited

U.S. PATENT DOCUMENTS

| | | | |
|---|---|---|---|
| 4,177,401 | 12/1979 | Yamane et al. | 313/485 |
| 4,187,446 | 2/1980 | Gross et al. | 315/58 |
| 4,311,942 | 1/1982 | Skeist et al. | 315/62 |
| 4,311,943 | 1/1982 | Gross et al. | 315/70 |
| 4,341,979 | 7/1982 | Gross et al. | 315/57 |
| 4,417,172 | 11/1983 | Touhou et al. | 313/156 |
| 4,434,385 | 2/1984 | Touho et al. | 313/161 |
| 4,549,110 | 10/1985 | Berman et al. | 313/485 |

FOREIGN PATENT DOCUMENTS 60862 4/1985 Japan .

*Primary Examiner*—David K. Moore
*Assistant Examiner*—K. Wieder
*Attorney, Agent, or Firm*—Carlo S. Bessone

[57] ABSTRACT

A low-pressure arc discharge apparatus having a magnetic field generating means for increasing the output of a discharge lamp is disclosed. The magnetic field generating means, which in one embodiment includes a plurality of permanent magnets, is disposed along the lamp for applying a constant transverse magnetic field over at least a portion of the positive discharge column produced in the arc discharge lamp operating at an ambient temperature greater than about 25° C.

8 Claims, 3 Drawing Figures

LOW PRESSURE ARC DISCHARGE LAMP APPARATUS WITH MAGNETIC FIELD GENERATING MEANS

The United States Government has rights to this invention pursuant to Contract No. DE-AC03-76SF00098 awarded by the United States Department of Energy.

TECHNICAL FIELD

This invention relates to a low-pressure arc discharge lamp apparatus and, more particularly, a fluorescent lamp apparatus having a magnetic field generating means for increasing the output of the lamp.

BACKGROUND OF THE INVENTION

Low-pressure mercury vapor arc discharge lamps are radiation sources which are used on a very large scale both for general illumination and for special purposes (e.g., photochemistry), because they convert the applied electric power very efficiently into radiation. In general these lamps consist of a sealed tubular envelope which may be straight or curved, for example, bent to form a circle or U-shaped. The envelope contains an ionizable medium which includes a gas mixture of mercury and one or more rare gasses in which a positive discharge column is produced. Means are present for maintaining this positive discharge column by supplying electric energy to the gas mixture. The means usually comprise two electrodes. Mainly ultraviolet radiation is produced in the discharge, the greatest part having wavelengths of approximately 2537 angstrom. The ultraviolet radiation is converted by means of a phosphor layer disposed on the internal surface of the lamp envelope, into radiation having waves of a longer length and a spectral distribution, depending on the phosphor material used, in the near ultraviolet or in the visible part of the spectrum.

Magnetic fields have been used with compact fluorescent lamps for use in incandescent fixtures as well as conventional and non-conventional elongated, tubular-shaped fluorescent lamps for various reasons. For example, U.S. Pat. No. 4,187,446, which issued to Gross et al on Feb. 5, 1980 and U.S. Pat. No. 4,311,942, which issued to Skeist et al on Jan. 19, 1982 disclose the use of an alternating, non-constant, electromagnetic field generated by a specially designed ballast to spread the arc periodically throughout the volume of a compact fluorescent lamp. U.S. Pat. No. 4,311,943, which issued to Gross et al on Jan. 19, 1982, combines the use of a recombination structure of fine fibers interposed in the arc path with an arc spreading coil which serves as all or part of the ballast of the fluorescent lamp. Since the ballast field is approximately 90 degrees out of phase with the current and light output, B is proportional to di/dt, thus the maximum ballast magnetic field occurs near zero light output which may not be optimum. Furthermore, practical ballast fields generated are relatively low and generally range in the order of 20 to 40 gauss. Additionally, generation of many ballast fields via coil windings require substantial changes in ballast design and may not be compatible with certain advanced high-frequency ballast designs.

U.S. Pat. No. 4,434,385, which issued to Touhou et al on Feb. 28, 1984 is still another patent using magnetic fields with fluorescent lamp. More specifically, this patent suggests the use of a magnetic field locally disposed around a non-conventional lamp for varying the light distribution direction and/or color of the lamp.

U.S. Pat. No. 4,417,172, which issued to Touhou et al on Nov. 22, 1983, relates primarily to suppressing low temperature flickering phenomena caused by moving striation in conventional fluorescent lamps by means of electromagnets or permanent magnets. The teachings of this patent are incorporated herein by reference. The field strengths suggested are chosen in a particular limit to stop the flickering within a desired time and to ensure the easiness of the starting under the relatively severe conditions of an ambient temperature of 0° C. and the power source voltage anticipated by the apparatus. More specifically, this reference teaches limiting the magnetic flux density Y at the center of a transverse section of the discharge tube operating at 0° C. to a value such that Y is less than $600\times+70$. The value X is equal to the quotient obtained by dividing the weighted mean value of the atomic weight of rare gas atoms in the discharge lamp envelope by a product of the pressure value in the lamp, the square of the value of the inner radius of the envelope, and the length of the envelope.

It has been discovered that an increase of approximately 30 percent in the ultraviolet output from a low-pressure arc discharge lamp can be achieved when magnetic fields of higher field strengths are employed at ambient temperatures greater than 25° C. (77° F.). It is known that at ambient temperature above about 25° C. (77° F.), the flickering phenomena is much less a problem than at 0° C. (32° F.). At ambient temperatures of 40° C. (104° F.) and higher normally encountered when a fluorescent lamp is installed in, for example, an enclosed wrap-around fixture, flickering is essentially non-existent.

SUMMARY OF THE INVENTION

It is, therefore, an object of the invention to obviate the disadvantages of the prior art.

It is another object of the invention to increase the output of a low-pressure arc discharge lamp operating at an ambient temperature greater than about 25° C.

It is still another object of the invention to provide an improved low-pressure arc discharge apparatus for operation at an ambient temperature greater than about 25° C.

These objects are accomplished, in one aspect of the invention, by the provision of a low-pressure arc discharge apparatus comprising a low-pressure arc discharge lamp for producing a positive column. The arc discharge lamp has a sealed tubular envelope of light-transmitting vitreous material containing an ionizable medium and having opposing ends. A pair of electrodes is respectively sealed at the ends of the envelope. A pair of electrical contact means is respectively connected to the pair of electrodes. Magnetic field generating means is disposed along the low-pressure arc discharge lamp for applying a constant transverse magnetic field of a predetermined magnetic flux density over at least a portion of a positive column produced in the arc discharge lamp. The magnetic field generating means is effective to increase the output of the low-pressure arc discharge lamp operating at an ambient temperature greater than about 25° C.

In accordance with further aspects of the present invention, the magnetic field generating means comprises at least one magnet.

In accordance with still further aspects of the present invention, the magnetic field generating means comprises a plurality of permanent magnets.

In accordance with the further teachings of the present invention, the magnetic field intensity of the magnetic field generating means is greater than $600\times+70$. The value X is equal to the quotient obtained by dividing the weighted mean value of the atomic weight of rare gas atoms in the envelope by a product of the pressure value in the envelope, the square of the value of the inner radius of the envelope, and length of the envelope.

In accordance with still further teachings of the present invention, the constant transverse magnetic field is applied over substantially the entire length of the positive column generated in the arc discharge lamp.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
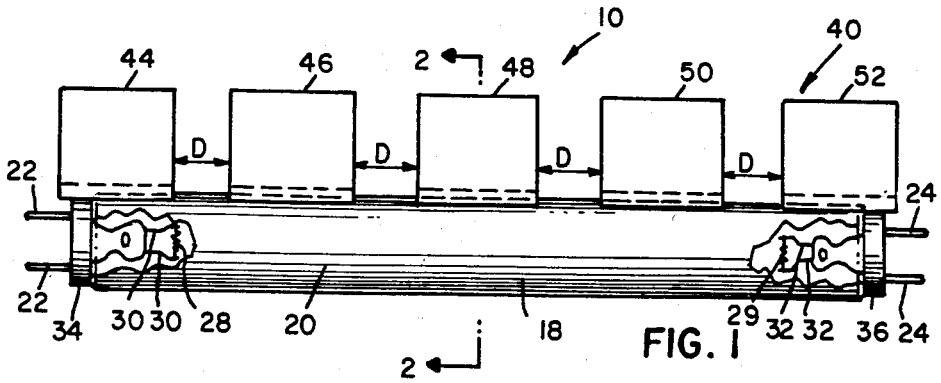
FIG. 1 is a side elevational view, partly broken away, of a low-pressure arc discharge lamp apparatus in accordance with a preferred embodiment of the invention.
Figure 2:
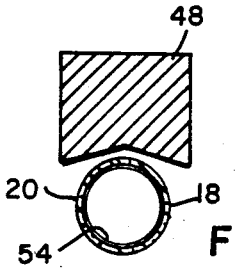
FIG. 2 is a cross-sectional view of FIG. 1 taken along the lines 2—2.

Referring now to the drawings with greater particularly, there is shown in FIGS. 1 and 2 a low-pressure arc discharge lamp assembly 10 according to a preferred embodiment of the invention. The assembly 10 includes a low-pressure arc discharge lamp 18 such as a fluorescent lamp having a sealed tubular envelope 20 of light-transmitting vitreous material (e.g., lime glass or quartz) and contains an ionizable medium including a quantity of mercury and an inert starting gas. The gas may consist of argon, neon, helium, krypton or a combination thereof at a low pressure in the range of about 1 to 4 mmHg. Preferably, phosphor layer 54 (FIG. 2) which converts the ultraviolet radiation generated in the discharge into visible light, is present on the inner surface of envelope 20. A pair of electrodes 28, 29 are respectively sealed at the ends of envelope 20. A pair of electrical conductors 30, 32 is respectively connected to each of the pair of electrodes 28, 29. An end cap 34, 36 attached to each end of envelope 20 and respectively includes a pair of pins 22, 24 electrically connected to electrical conductors 30, 32 and formed to provide electrical connection to an external potential source of energization (not shown).

According to the teachings of the invention, low-pressure arc discharge apparatus 10 further includes a magnetic field generating means 40 disposed along low-pressure arc discharge lamp 18 for applying a constant transverse magnetic field of a predetermined magnetic flux density. Preferably, magnetic field generating means 40 is applied over substantially the entire length of the positive discharge column generated in lamp 18 and is effective in increasing the output of lamp 18 operating at an ambient temperature greater than about 25° C.

In a preferred embodiment of the present invention, as best shown in FIGS. 1 and 2, magnetic field generating means 40 comprises a plurality of permanent magnets 44, 46, 48, 50, 52. The permanent magnets an be spaced apart from each other a predetermined distance D. Preferably, the average magnetic field intensity generated by the permanent magnets is greater than $600\times+70$. The value X in the equation is equal to the quotient obtained by dividing the weighted mean value of the atomic weight or rare gas atoms in the envelope by a product of the pressure value in the envelope, the square of the value of the inner radius of the envelope, and the length of the envelope.

EXAMPLE 1

In a practical embodiment of the above-described apparatus 10, the low-pressure arc discharge lamp used was an F14T12 fluorescent lamp having a Cool White phosphor disposed on the internal surface of a lime glass envelope. The lamp had an envelope length of 14.22 inches (361.2 mm), an external diameter of 1.5 inches (38.0 mm), and an internal radius of 0.73 inch (18.5 mm). The value X was equal to 0.13. The lamp contained an argon fill with a mean atomic weight of 40.0 at a pressure of approximately 2.5 torr. Five permanent magnets were disposed along the fluorescent lamp for applying a constant transverse magnetic field over substantially the entire length of the positive column produced in the lamp. The distance D between adjacent magnets was approximately 0.6 inch (15.2 mm). The permanent magnets used were Model MB-2 manufactured by Newport Research Corporation of Fountain Valley, Calif. Each magnet had a height of approximately 2.38 inches (60.5 mm), a width of approximately 1.82 inches (46.2 mm) and a length of approximately 2.40 inches (61.0 mm). The transverse field intensity of each magnet varied from 40 to 800 gauss across the lamp cross-section depending on the distance between the envelope and the pole face of the magnet. The axial field intensity, measured in the direction of arc current flow, was less than 10 gauss. The apparatus was operated in a 2.4 meter integrating sphere at an ambient temperature of approximately 77° F. (25° C.). At a constant lamp power of approximately 13.64 watts and an average magnetic field intensity of 200 gauss, lamp lumen output (and efficacy) increased approximately 6.0 percent. The lamp was operated at a frequency of 60 hertz alternating current.

EXAMPLE II

In another practical embodiment of the above-described apparatus 10, the low-pressure arc discharge lamp used was an F14T12 fluorescent lamp having a Cool White phosphor disposed on the internal surface of a lime glass envelope. The lamp had an envelope length of 14.22 inches (361.2 mm), an external diameter of 1.5 inches (38 mm), and an internal radius of 0.73 inch (18.5 mm). The lamp contained an argon fill with a mean atomic weight of 40.0 at a pressure of approximately 2.5 torr. Consequently, the value X is equal to 0.13. Five permanent magnets were disposed along the fluorescent lamp for applying a constant transverse magnetic field over substantially the entire length of the positive column produced in the lamp. The distance D between adjacent magnets was equal to zero. The permanent magnets used were Model MB-2 manufactured by Newport Research Corporation of Fountain Valley, Calif. Each magnet had a height of approximately 2.38 inches (60.5 mm), a width of approximately 1.82 inches (46.2 mm) and a length of approximately 2.40 inches (61.0 mm). The transverse field intensity of each magnet varied from 40 to 800 gauss across the lamp cross section depending on the distance between the envelope and the pole face of the magnet. The axial field intensity, measured in the direction of arc current flow, was less than 10 gauss. The apparatus was operated in a 2.4 meter integrating sphere at an ambient temperature of approximately 77° F. (25° C.). At a constant lamp power of approximately 14.51 watts and an average magnetic field intensity of 200 gauss, lamp lumen output (and efficacy) increased approximately 10 percent. The lamp was operated at a frequency of 60 hertz alternating current.

EXAMPLE III

In another practical embodiment of the above-described apparatus, the low pressure arc discharge lamp used was a G15T8 germicidal lamp having a quartz glass envelope. The lamp had an envelope length of 17.22 inches (437.4 mm), and an external diameter of 1.0 inch (25.4 mm), and an internal radius of 0.48 inch (12.2 mm). The lamp contained an argon fill with a mean atomic weight of 40.0 at a pressure of approximately 3.0 torr. The value X was equal to 0.20. A permanent magnet was placed against the envelope of the lamp for applying a constant transverse magnetic field over a portion of the positive volume produced in the lamp. The permanent magnet used was Model MB-2 manufactured by Newport Research Corporation of Fountain Valley, Calif. having a height of approximately 2.38 inches (60.5 mm), a width of approximately 1.82 inches (46.2 mm) and a length of approximately 2.40 inches (61.0 mm). The transverse field intensity of the magnet varied from 40 to 800 gauss across the lamp cross-section depending on the distance between the envelope and the pole face of the magnet. The axial field intensity was less than 10 gauss when measured in the direction of arc current flow. A quarter meter monochromator was used to observe the ultraviolet output (2537 angstrom). The apparatus was operated at an ambient temperature of approximately 77° F. (25° C.). At a constant lamp power of approximately 15.0 watts and an average magnetic field intensity of 200 gauss, ultraviolet output (2537 angstrom) increased approximately 20.0 percent. The arc voltage of the lamp increased approximately 2.0 volts. The lamp was operated at a frequency of 60 hertz alternating current.

EXAMPLE IV

In another practical embodiment of the above-described apparatus, the low-pressure arc discharge lamp used was an F40T12 fluorescent lamp having an envelope with a quartz glass center portion. The lamp had an overall length of 47.22 inches (1199.4 mm), an external diameter of 1.5 inches (38.0 mm), and an internal radius of 0.73 inches (18.5 mm). The lamp contained an argon fill with a mean atomic weight of 40.0 at a pressure of approximately 2.5 torr. Consequently, the value X was equal to 0.04. A permanent magnet was placed against the envelope at the center of the lamp for applying a constant transverse magnetic field over a portion of the positive column induced in the lamp. The permanent magnet used was Model MB-2 manufactured by Newport Research Corporation of Fountain Valley, Calif. having a height of approximately 2.38 inches (60.5 mm), a width of approximately 1.82 inches (46.2 mm) and a length of approximately 2.40 inches (61.0 mm). The transverse field intensity of the magnet varied from 40 to 800 gauss across the lamp cross-section depending on the distance between the envelope and the pole face of the magnet. The axial field intensity was less than 10 gauss when measured in the direction of arc current flow. A quarter meter monochromator was used to observe the change in ultraviolet output (2537 angstrom). The apparatus was operated at an ambient temperature of approximately 77° F. (25° C.). At a constant lamp power of approximately 40.0 watts and an average magnetic field intensity of 200 gauss, ultraviolet output (2537 angstrom) increased approximately 20.0 percent. The lamp was operated at a frequency of 60 hertz alternating current.

EXAMPLE V

In another practical embodiment of the above-described apparatus, the low-pressure arc discharge lamp used was an F40T12 fluorescent lamp operating at 30 kilohertz alternating current and having an envelope with a quartz glass center portion. The lamp had an envelope length of 47.22 inches (1199.4 mm), an external diameter of 1.5 inches (38.0 mm), and an internal radius of 0.73 inches (18.5 mm). The lamp contained an argon fill with a mean atomic weight of 40.0 at a pressure of approximately 2.5 torr. The value X was equal to 0.04. A permanent magnet was placed against the envelope at the center of the lamp for applying a constant transverse magnetic field over a portion of the positive column produced in the lamp. The permanent magnet used was Model MB-2 manufactured by Newport Research Corporation of Fountain Valley Calif. having a height of approximately 2.38 inches (60.5 mm), a width of approximately 1.82 inches (46.2 mm) and a length of approximately 2.40 inches (61.0 mm). The transverse field intensity of the magnet varied from 40 to 800 gauss across the lamp cross-section depending the distance between the envelope and the pole face of the magnet. The axial field intensity was less than 10 gauss when measured in the direction of arc current flow. A quarter meter monochromator was used to observe the change in ultraviolet output (2537 angstrom). The apparatus was operated at an ambient temperature of approximately 77° F. (25° C.). At a constant lamp power of approximately 40.0 watts and an average magnetic field intensity of 200 gauss, ultraviolet output (2537 angstrom) increased approximately 20.0 percent. The lamp as mentioned above as operated at a frequency of 30 kilohertz alternating current.

EXAMPLE VI

Figure 3:
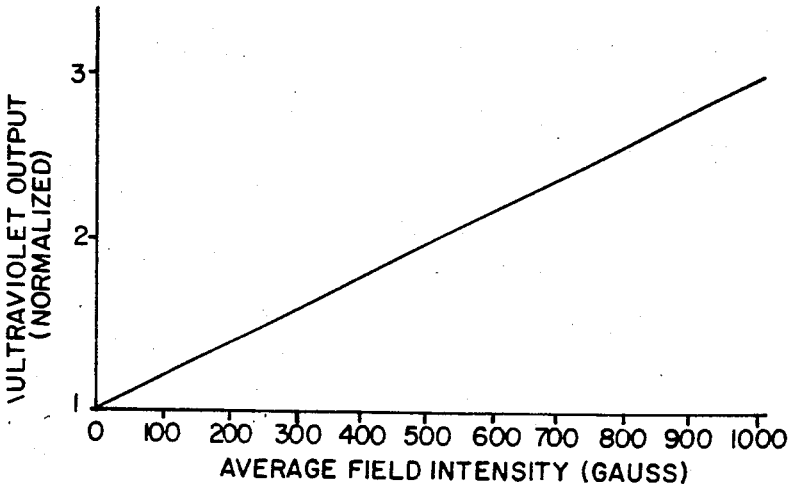
FIG. 3 is a graph showing ultraviolet output as a function of average transverse field intensity in accordance with a preferred embodiment of the invention.

In another practical embodiment of the above-described apparatus, the low-pressure arc discharge lamp used was an F40T12 fluorescent lamp having an envelope with a quartz glass center portion. The lamp has an envelope length of 47.22 inches (1199.4 mm), an external diameter of 1.5 inches (38.0 mm), and an internal radius of 0.73 inches (18.5 mm). The lamp contained an argon fill with a mean atomic weight of 40.0 at a pressure of approximately 2.5 torr. Consequently the value X was equal to 0.04. A pair of donut-shaped electromagnets were positioned on opposite sides of the center portion of the lamp in a "Helmholtz" configuration for applying a constant transverse magnetic field over the center portion of the positive column produced in the lamp. The electromagnets used were Model 1.5 KG Helmholtz, manufactured by Magnecoil Corp. of Peabody, Mass. Each magnet had an outside diameter of 5.63 inches (142.9 mm), an inside diameter of 2.0 inches (50.8 mm), and a height of 2.38 inches (60.3 mm). A quarter meter monochromator was used to observe the ultraviolet output (2537 angstrom). The apparatus was operated at an ambient temperature of approximately 104° F. (40° C.). The current through the electromagnets was adjusted to vary the transverse field intensity from 0 to 1000 gauss. At a constant lamp current of 430 milliamps, the ultraviolet output (2537 angstrom) increased as a function of the average transverse field intensity as shown in FIG. 3.

EXAMPLE VII

In another practical embodiment of the above-described apparatus, the low-pressure arc discharge lamp used was an F40T12 fluorescent lamp having an envelope with a quartz glass center portion. The lamp had an envelope length of 47.22 inches (1199.4 mm), an external diameter of 1.5 inches (38.0 mm), and an internal radius of 0.73 inches (18.5 mm). The lamp contained an argon fill with a mean atomic weight of 40.0 at a pressure of approximately 2.5 torr. The value X was equal to 0.04. A single permanent C-shaped magnet was disposed at the center portion of the lamp for applying a constant transverse magnetic field over the center portion of the positive column induced in the lamp. The magnet had a gap between the legs of the C-shaped magnet of 3.0 inches (76.2 mm), a leg length of approximately 7.0 inches (178.0 mm), and a width of 3.0 inches (76.2 mm). The permanent magnet produced an average transverse field intensity of approximately 1300 gauss across the lamp when it was placed between the legs of the C-shaped magnet. The apparatus was operated at an ambient temperature of approximately 77° F. (25° C.). At a constant lamp power of approximately 40.0 watts, an increase in the ultraviolet output (2537 angstrom) was observed.

EXAMPLE VIII

In another practical embodiment of the above-described apparatus, the low-pressure arc discharge lamp used was an F4T5 fluorescent lamp having a quartz glass envelope. The lamp had an envelope length of 5.35 inches (135.9 mm), an external diameter 0.63 inches (15.9 mm), and an internal radius of 0.295 inch (7.5 mm). The lamp contained an argon fill with a mean atomic weight of 40.0 at a pressure of approximately 7.4 torr. Consequently the value X was equal to 0.71. A pair of donut-shaped electromagnets were positioned on opposite sides of the F4T5 lamp in a well known "Helmholtz" configuration for applying a constant transverse magnetic field over substantially the entire length of the positive column produced in the lamp. The electromagnets used were Model 1.5 KG Helmholtz, manufactured by Magnecoil Corp. of Peabody, Mass. Each magnet had an outside diameter of 5.63 inches (142.9 mm), an inside diameter of 2.0 inches (50.8 mm), an inside diameter of 2.0 inches (50.8 mm), and a height of 2.38 inches (60.3 mm). A quarter meter monochromator was used to observe the ultraviolet output (2537 angstrom). The apparatus was operated at an ambient temperature of approximately 104° F. (40° C.). The current through the electromagnets was adjusted to produce transverse field intensities of 500, 800 and 1000 gauss. At a constant lamp current of 170 milliamps, the ultraviolet output (2537 angstrom) increased 4, 12 and 19 percent, respectively.

Thus there has been shown and described a low-pressure arc discharge apparatus having a magnetic field generating means for increasing the output of a discharge lamp. The magnetic field generating means is disposed along the lamp for applying a constant transverse magnetic field over at least a portion of the positive column produced in the arc discharge lamp. The magnetic field generating means is effective to increase the output of the low-pressure arc discharge lamp operating at an ambient temperature greater than about 25° C. Such a means does not require changes in ballast design and is compatible with advanced high-frequency ballast designs.

While there have been shown and described what are at present considered to be the preferred embodiments of the invention, it will be apparent to those skilled in the art that various changes and modifications can be made herein without departing from the scope of the invention as defined by the appended claims. For example, although the invention is shown with a linear-shaped arc discharge lamp, it is clear that the lamp could be, for example, U-shaped or circular-shaped.

We claim:

1. A low-pressure arc discharge apparatus comprising:

a low-pressure arc discharge lamp for producing a positive column. said arc discharge lamp having a sealed tubular envelope of light-transmitting vitreous material containing an ionizable medium and having opposing ends, a pair of electrodes respectively sealed at said ends of said envelope, and a pair of electrical conductors respectively connected to each of said pair of electrodes, said low-pressure arc discharge lamp operating at an ambient temperature greater than about 25° C.; and magnetic field generating means disposed along said low-pressure arc discharge lamp for applying a constant transverse magnetic field of a predetermined magnetic field intensity over at least a portion of said positive column produced in said arc discharge lamp, said magnetic field intensity of said magnetic field generating means being greater than $600\times+70$ gauss, the value X being equal to the quotient obtained by dividing the weighted mean value of the atomic weight of rare gas atoms in said envelope by a product of the pressure value in said envelope, the square of the value of the inner radius of said envelope, and the length of said envelope, said magnetic field generating means being effective to increase the output of said low-pressure arc discharge lamp.

2. The low-pressure arc discharge apparatus of claim 1 wherein said low-pressure arc discharge lamp is a fluorescent lamp.

3. The low-pressure arc discharge apparatus of claim 1 wherein said envelope is quartz.

4. The low-pressure arc discharge apparatus of claim 1 wherein said low-pressure arc discharge lamp further includes a phosphor layer disposed on the internal surface of said envelope.

5. The low-pressure arc discharge apparatus of claim 1 wherein said magnetic field generating means comprises at least one magnet.

6. The low-pressure arc discharge apparatus of claim 1 wherein said magnetic field generating means comprises a plurality of permanent magnets.

7. The low-pressure arc discharge apparatus of claim 1 wherein said constant transverse magnetic field is applied over substantially the entire length of said positive column generated in said arc discharge lamp.

8. The low-pressure arc discharge apparatus of claim 1 wherein said ambient temperature is equal to about 40° C.

* * * * *